US006431855B1

(12) United States Patent
Pedersen

(10) Patent No.: US 6,431,855 B1
(45) Date of Patent: Aug. 13, 2002

(54) PORTABLE FLARE STACK

(75) Inventor: Eldon Theodore Pedersen, Brooks (CA)

(73) Assignee: Porta-Stack Inc., Brooks (CA)

( * ) Notice: Subject to any disclaimer, the term of this patent is extended or adjusted under 35 U.S.C. 154(b) by 0 days.

(21) Appl. No.: 09/617,597

(22) Filed: Jul. 7, 2000

(30) Foreign Application Priority Data

Jul. 9, 1999 (CA) ..... 2277248

(51) Int. Cl.[7] ..... F23D 14/00
(52) U.S. Cl. ..... 431/202; 431/5
(58) Field of Search ..... 431/202, 5; 239/164, 239/165, 172, 173, 174, 175; 126/271.2, 276; 47/1.44; 166/256; 110/240, 241

(56) References Cited

U.S. PATENT DOCUMENTS

| | | | | |
|---|---|---|---|---|
| 1,835,132 A | * | 12/1931 | Anania | |
| 2,454,365 A | * | 11/1948 | Woolery | |
| 3,224,430 A | * | 12/1965 | Reifschneider et al. | |
| 3,655,130 A | * | 4/1972 | Patirick | |
| 3,756,765 A | * | 9/1973 | Sparrow et al. | |
| 3,810,733 A | * | 5/1974 | Reagan | |
| 3,814,036 A | * | 6/1974 | Fanton | |
| 3,880,573 A | * | 4/1975 | Simmons | |
| 3,914,094 A | * | 10/1975 | Landry | |
| 4,092,095 A | | 5/1978 | Straitz, III | 431/114 |
| 4,255,120 A | | 3/1981 | Straitz, III | 431/202 |
| 4,682,578 A | * | 7/1987 | Schmidt | |
| 4,789,099 A | * | 12/1988 | Hager | |
| 5,380,195 A | | 1/1995 | Reid et al. | 431/202 |
| 5,429,496 A | * | 7/1995 | Stephens et al. | |
| 5,803,726 A | * | 9/1998 | Bacon | |
| 5,807,095 A | | 9/1998 | Gustafson et al. | 431/202 |
| 5,882,187 A | | 3/1999 | Gustafson et al. | 431/202 |
| 6,014,835 A | * | 1/2000 | Pivonka | |

FOREIGN PATENT DOCUMENTS

| | | | | |
|---|---|---|---|---|
| EP | 0414979 | * | 3/1991 | 110/240 |

* cited by examiner

*Primary Examiner*—Carl D. Price
(74) *Attorney, Agent, or Firm*—Christensen O'Connor Johnson Kindness PLLC

(57) ABSTRACT

A portable flare stack includes a base having a first end and a second end. A tubular conduit extends substantially the length of the base. The tubular conduit has a flaring end and a gas connection end. The tubular conduit is pivotally mounted at one of the first end and the second end of the base for movement between a travel position and a flaring position in which the tubular conduit extends substantially perpendicular to the chassis. A counterweight is positioned adjacent to the gas connection end of the tubular conduit. A drive mechanism is provided for moving the tubular conduit, as required, between the travel position and the flaring position.

6 Claims, 3 Drawing Sheets

PORTABLE FLARE STACK

FIELD OF THE INVENTION

The present invention relates to a portable flare stack.

BACKGROUND OF THE INVENTION

It has been a common practise in the oil and gas industry to vent gas to atmosphere when servicing a gas well. For example, when fracturing a well to improve flow rates, it has been common to vent gas to atmosphere for between twelve and twenty four hours in order to rid the well of residual fracturing fluids which might otherwise plug the well.

In recent years there have been environmental protection laws passed that prohibit venting of gas to atmosphere. Any excess gas produced by a gas well must be either captured or sent to a gas flare. There is, therefore, a need for a portable flare stack that can readily be transported to gas wells to flare gas for time durations of twenty four hours or less.

U.S. Pat. No. 4,255,120 entitled "Portable Safety Flare for Combustion of Waste Gases" which issued to Straitz in 1981 discloses a portable gas flare built onto a truck and trailer unit. This vehicle mounted portable safety flare is too large and, consequently, too expensive to use on short duration gas flaring jobs involving relatively small volumes of gas.

SUMMARY OF THE INVENTION

What is required is a smaller portable flare stack that is suited for use for short duration gas flaring involving relatively small volumes of gas.

According to the present invention there is provided a portable flare stack which includes a base having a first end and a second end. A tubular conduit extends substantially the length of the base. The tubular conduit has a flaring end and a gas connection end. The tubular conduit is pivotally mounted at one of the first end and the second end of the base for movement between a travel position and a flaring position in which the tubular conduit extends substantially perpendicular to the base. A counterweight is positioned adjacent to the gas connection end of the tubular conduit. A drive mechanism is provided for moving the tubular conduit, as required, between the travel position and the flaring position.

The portable flare stack, as described above, is simple and light weight. It is preferred that the base is a trailer chassis having ground engaging wheels at the second end and a hitch at the first end. The trailer chassis can be moved on the ground engaging wheels with the tubular conduit in the travel position. Once at a well site, the tubular conduit can rapidly be pivoted into the gas flaring position and the gas connection end of the tubular conduit connected to a source of gas. The movement of the tubular conduit between the travel position and the gas flaring position is made easier by the counterweight which reduces the force necessary to effect the required pivotal movement. This enables a simpler form of drive mechanism to be used for moving the tubular conduit between the travel position and the flaring position. The preferred drive mechanism includes a cable supported on a reel which is rotatably mounted to the chassis. The cable has a free end secured to the gas connection end of the tubular conduit. The cable extends over several direction altering pulleys. Rotation of the reel in a first direction shortens the cable. Rotation of the reel in a second direction lengthens the cable. The cable exerts a force upon the gas connection end of the tubular conduit to pivotally move the tubular conduit between the travel position and the flaring position.

Although beneficial results may be obtained through the use of the portable flare stack, as described above, it is preferred that the chassis have an extendible and retractable support leg at the first end, so that the first end of the trailer chassis is supported when the hitch is disconnected from the tow vehicle. It is also preferred that the chassis have outrigger support legs at the second end.

Although beneficial result may be obtained through the use of the portable flare stack, as described above, it is preferred that a support be positioned adjacent the first end to receive the tubular conduit when the tubular conduit is in the travel position. This prevents jarring impacts during travel from damaging the pivotal connection by which the tubular conduit is mounted'to the trailer chassis.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
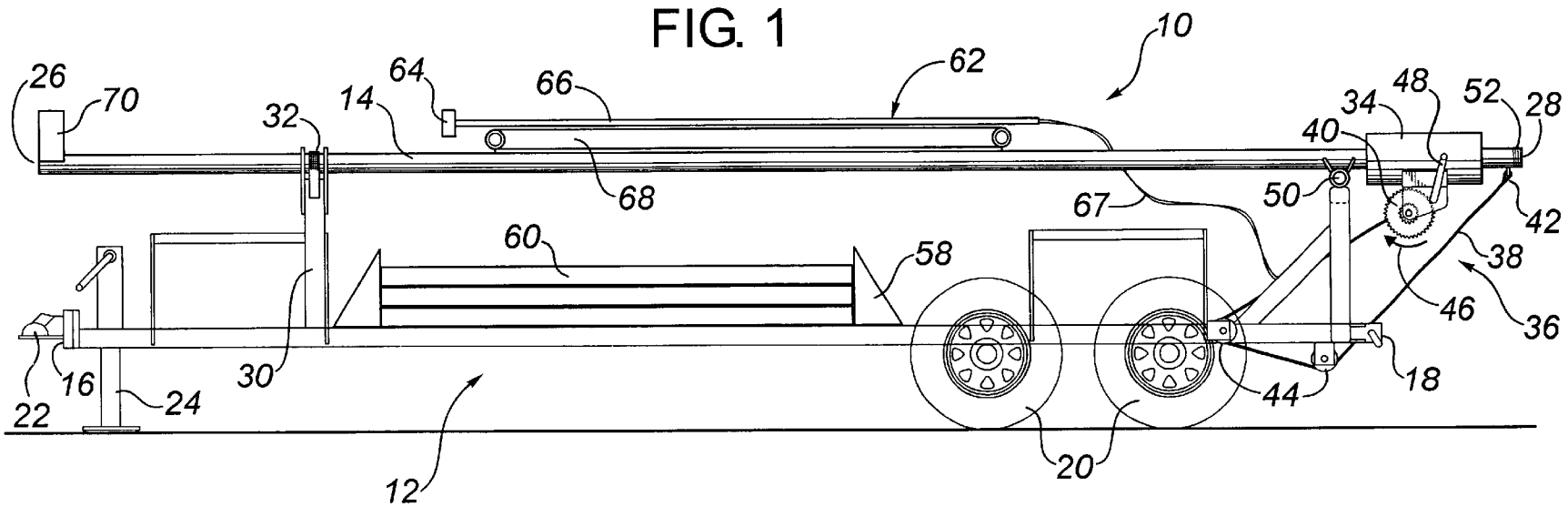
FIG. 1 is a side elevation view of a portable flare stack constructed according to the teachings of the present invention, with the tubular conduit of the flare stack in a travel position.

The preferred embodiment, a portable flare stack generally identified by reference numeral 10, will now be described with reference to FIGS. 1 through 3.

Referring to FIG. 1, portable flare stack 10 includes a trailer chassis 12 and a tubular conduit 14. Chassis 12 has a first end 16 and a second end 18. Support wheels 20 underlie second. end 18 of chassis 12. A hitch 22 is positioned at first end 16 of chassis 12. An extendible and retractable support leg 24 underlies first end 16 of chassis 12. Support leg 24 provides support to first end 16 of trailer chassis 12 when hitch 22 is not coupled to a tow vehicle (not shown). Referring to FIG. 3, outrigger support legs 25 are position at second end 18 of chassis 12. Outrigger support legs 25 are extendible horizontally outwardly from chassis 12, in addition to being vertically extendible. Tubular conduit 14 extends substantially the length of chassis 12. Tubular conduit 14 has a flaring end 26 and a gas connection end 28.

Figure 2:
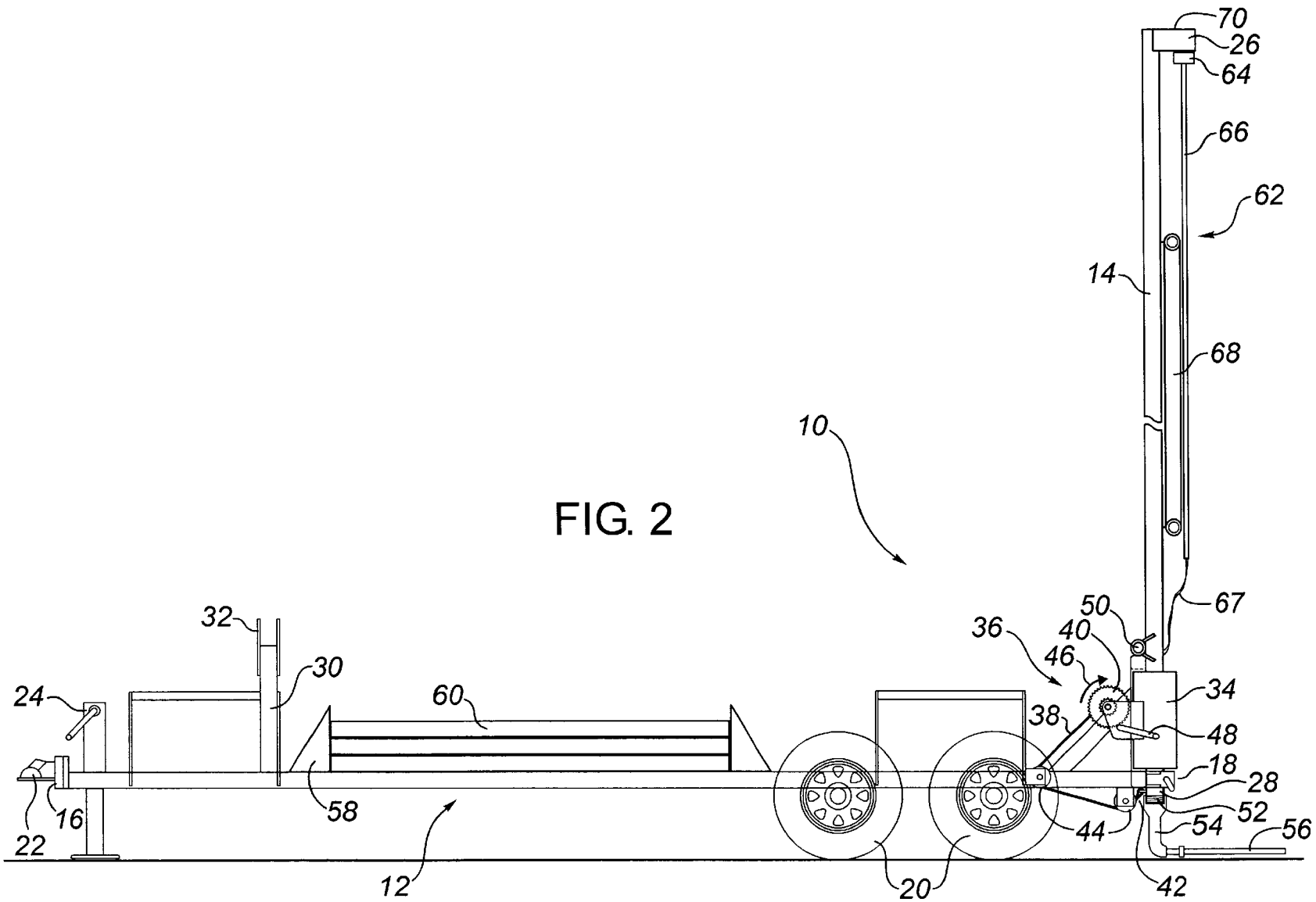
FIG. 2 is a side elevation view of the portable flare stack illustrated in FIG. 1, with the tubular conduit of the flare stack in a gas flaring position.
Figure 3:
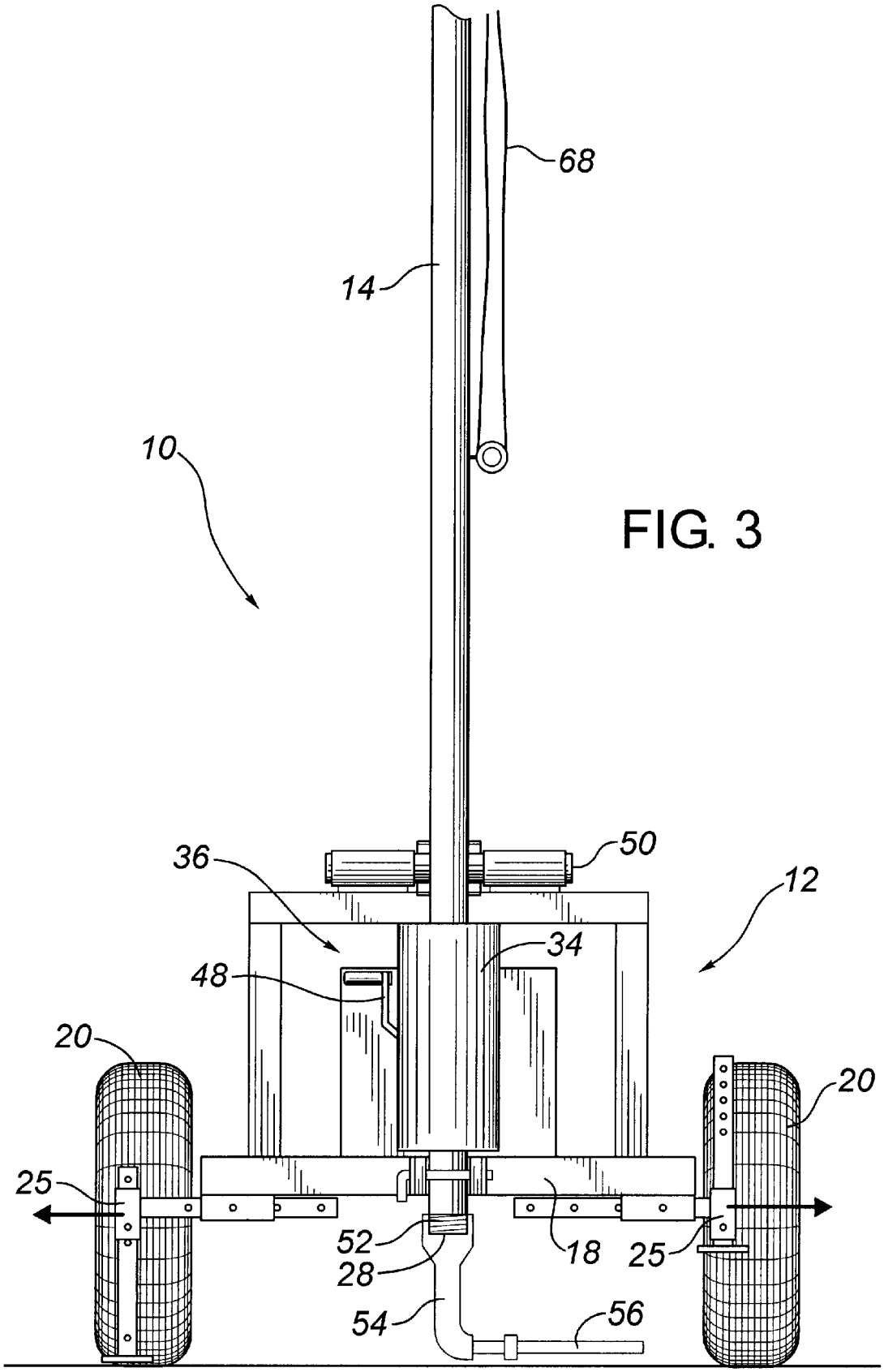
FIG. 3 is an end elevation view of the portable flare stack illustrated in FIG. 2.

Referring to FIGS. 1 and 2, tubular conduit 14 is pivotally mounted at second end 18 of chassis 12 for movement about a pivot 50 between a travel position in which tubular conduit 14 extends substantially parallel to chassis 12, as shown in FIG. 1, and a flaring position in which tubular conduit 14 extends substantially perpendicular to chassis 12, as shown in FIG. 2. Referring to FIG. 1, a support 30 is positioned adjacent to first end 16 of chassis 12 to receive tubular conduit 14 when tubular conduit 14 is in the travel position. Tubular conduit 14 rests in a saddle 32 which is positioned at a remote end of support 30. It is preferred that tubular conduit 14 be secured into saddle 32 with a bungee cord to prevent tubular conduit 14 from being damaged by bouncing on support 30 during travel.

A counterweight 34 is positioned adjacent to gas connection end 28 of tubular conduit 14. A drive mechanism 36 is provided for moving tubular conduit 14 as required between the travel position and the flaring position. Drive mechanism 36 includes a cable 38 supported on a reel 40 which is rotatably mounted to tubular conduit 14. A weight of counterweight 34 is selected so that a center of gravity of tubular conduit 14 and drive mechanism 36 attached thereto lies close to pivot 50. The weight distribution enables, tubular conduit 14 to rest on support 30 under the force of gravity when in the travel position. However, because counterweight 34 positioned adjacent gas connection end 28 tubular conduit 14 is biased into the flaring position. This is important as it reduces the force necessary to pivotally move tubular conduit 14 from the travel position in FIG. 1 to the flaring position in FIGS. 2 and 3. Chassis 12 is stabilized in the flaring position by deploying outrigger support legs 25.

Cable 38 has a free end 42 secured to gas connection end 28 of tubular conduit 14. Cable 38 extends over several direction altering pulleys 44. Rotation of reel 40 in a first direction indicated by curved arrow 46 shortens cable 38, thereby exerting a force upon gas connection end 28 of tubular conduit 14 to pivotally move tubular conduit 14 from the travel position to the flaring position. Rotation of reel 40 in a direction opposite to that indicated by arrow 46 lengthens cable 38, thereby removing the force on gas connection end 28 and allowing tubular conduit 14 to pivotally move under the force of gravity from the flaring position to the travel position. When drive mechanism 36 for rotation of reel 40 is manual, a handcrank 48 is used to rotate reel 40. It will be recognized that a motorized drive (not shown) can be substituted for handcrank 48.

Referring to FIG. 1, external surface 52 at gas connection end 28 of tubular conduit 14 is threaded. Referring to FIGS. 2 and 3, when gas is to be flared, a matingly threaded connector 54 connects a source of gas to be flared 56 to gas connection end 28 of tubular conduit 14.

Referring to FIG. 2, there are some additional features that can be added to portable flare stack 10 to improve its operation. It is preferred that a pipe rack 58 be mounted to chassis 12 to carry lengths of pipe 60 required for gas connection. It is also preferred that a pilot igniter, generally identified by reference numeral 62, be mounted to tubular conduit 14. Pilot igniter 62 has a pilot flame nozzle 64 mounted at the end of tubular member 66 which connects to a pilot gas supply line 67 connected to a supply of gas (not shown). A line and pulley linkage 68 is provided to raise pilot flame nozzle 64 into position adjacent flaring end 26 of tubular conduit 14. It is preferred that a wind shield 70 be mounted at flaring end 26 of tubular conduit 14 to provide the flame being extinguished by wind gusts.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A portable flare stack, comprising:

a chassis for a trailer, the chassis having a first end and a second end, the chassis having ground engaging wheels at the second end and a hitch at the first end;

a tubular conduit extending substantially the length of the chassis, the tubular conduit having a flaring end and a gas connection end, the tubular conduit being pivotally mounted to a pivot at one of the first end and the second end of the chassis for movement between a travel position in which the tubular conduit is positioned substantially parallel to the chassis and a flaring position in which the tubular conduit extends substantially perpendicular to the chassis, the tubular conduit being asymmetrically mounted with the pivot positioned toward the gas connection end;

a counterweight being positioned adjacent to the gas connection end of the tubular conduit, the counterweight repositioning a center of gravity of the tubular conduit close to the pivot, thereby reducing the force necessary to move the tubular conduit from the travel position to the flaring position; and a drive mechanism for moving the tubular conduit as required between the travel position and the flaring position, wherein the drive mechanism includes a cable supported on a reel which is rotatably mounted to the gas connection end of the tubular conduit, the cable having a free, end secured to the gas connection end of the tubular conduit, the cable extending over several direction altering pulleys, rotation of the real shortening and lengthening the cable thereby exerting a force upon the gas connection end of the tubular conduit to pivotally move the tubular conduit between the travel position and the flaring position.

2. The portable flare stack as defined in claim 1, wherein the chassis has an extendible and retractable support leg at the first end.

3. The portable flare stack as defined in claim 1, wherein a support the chassis has outrigger support legs at the second end.

4. The portable flare stack as defined in claim 1, wherein a support is positioned adjacent the first end to receive the tubular conduit when the tubular conduit is in the travel position.

5. The portable flare stack as defined in claim 1, wherein a pilot igniter is mounted on the tubular conduit, the pilot igniter being movable between an operative position adjacent the flaring end of the tubular conduit and an inoperative position spaced from the flaring end of the tubular conduit.

6. A portable flare stack, comprising:

a chassis for a trailer, the chassis having a first end and a second end, the chassis having ground engaging wheels at the second end and a hitch at the first end;

a tubular conduit extending substantially the length of the chassis, the tubular conduit having a flaring end and a gas connection end, the tubular conduit being pivotally mounted at one of the first end and the second end of the chassis for movement between a travel position in which the tubular conduit is positioned substantially parallel to the chassis and a flaring position in which the tubular conduit extends substantially perpendicular to the chassis;

a counterweight positioned adjacent to the gas connection end of the tubular conduit; and a drive mechanism for moving the tubular conduit as required between the travel position and the flaring position, wherein a pilot igniter is mounted on the tubular conduit, the pilot igniter being movable between an operative position adjacent the flaring end of the tubular conduit and an inoperative position spaced from the flaring end of the tubular conduit.

* * * * *

UNITED STATES PATENT AND TRADEMARK OFFICE

CERTIFICATE OF CORRECTION

PATENT NO. : 6,431,855 B1
DATED : August 13, 2002
INVENTOR(S) : E.T. Pedersen

It is certified that error appears in the above-identified patent and that said Letters Patent is hereby corrected as shown below:

Column 4,
Line 18, “free, end” should read -- free end --
Line 20, “real” should read -- reel --
Line 29, “a support the chassis” should read -- the chassis --

Signed and Sealed this

Eleventh Day of February, 2003

JAMES E. ROGAN
*Director of the United States Patent and Trademark Office*